US006513916B2

(12) United States Patent
Isono et al.

(10) Patent No.: US 6,513,916 B2
(45) Date of Patent: Feb. 4, 2003

(54) INK JET HEAD AND MANUFACTURING METHOD THEREOF

(75) Inventors: Hitoshi Isono, Tenri (JP); Yoshinori Nakajima, Joyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/864,191

(22) Filed: May 25, 2001

(65) Prior Publication Data

US 2001/0055049 A1 Dec. 27, 2001

(30) Foreign Application Priority Data

May 26, 2000 (JP) ..... 2000-156079

(51) Int. Cl.[7] ..... B41J 2/16
(52) U.S. Cl. ..... 347/68; 347/69
(58) Field of Search ..... 347/54, 55, 68, 347/69

(56) References Cited

U.S. PATENT DOCUMENTS 5,016,028 A * 5/1991 Temple ..... 347/69
5,631,680 A * 5/1997 Sugahara ..... 347/69

FOREIGN PATENT DOCUMENTS

JP A6316065 11/1994

* cited by examiner

*Primary Examiner*—Anh T. N. Vo
(74) *Attorney, Agent, or Firm*—Birch, Stewart, Kolasch & Birch, LLP

(57) ABSTRACT

An ink jet head which has been improved to enable reliable connection of an electrode to an external portion without increasing manufacturing cost is provided. The ink jet head includes a base member, a cover member, a nozzle plate, and a plurality of electrode connecting portions. The electrode connecting portions are electrically isolated by second grooves formed in the surface of the base member. The surface of the electrode connecting portions are substantially flush with the upper surfaces of the walls.

11 Claims, 16 Drawing Sheets

INK JET HEAD AND MANUFACTURING METHOD THEREOF

BACKGROUND OF THE INVENTION

1. Field of the Invention

The present invention generally relates to ink jet heads and, more specifically, to an ink jet head which has been improved to enable reliable connection of an external electrode and an electrode connecting portion by wire bonding or the like. The invention also relates to a method of manufacturing such an ink jet head.

2. Description of the Background Art

In recent years, a non impact printer such as an ink jet type printer which is adapted to provide colorization and higher gray scale level is rapidly diffused taking the place of an impact printer. Among such printers, a drop on demand type printer which ejects only a required amount of ink for printing has received a great deal of attention because of its high printing efficiency, low cost and low running cost and the like. A Kaiser type printer using a piezoelectric element or a thermal jet type printer is primarily used.

However, a Kaiser type printer is not readily reduced in size and thus unsuitable for greater integration. A thermal jet type printer is suitable for greater integration, but must meet strict requirements for long-lasting ink since it utilizes for ejection the energy of bubbles produced in the ink by a heater. In addition, in the thermal jet type printer, the heater life is limited and power consumption is considerable.

To solve the above mentioned problems, an ink jet type printer utilizing a shear mode of a piezoelectric material has been proposed. In this printer, an electric field is applied in the direction orthogonal to the polarizing direction of the piezoelectric material with use of an electrode formed on an ink channel wall of the piezoelectric material to deform the channel wall in the shear mode, so that ink droplets are ejected by pressure vibration caused at the time. As such, the ink jet type printer is adapted to provide higher density of nozzles, lower power consumption, and higher driving frequency. The structure of such an ink jet head utilizing the shear mode will be described with reference to FIG. 20.

Referring to FIG. 20, the ink jet head includes a base member 1 having a plurality of grooves 4 formed in a piezoelectric material which has been subjected to a polarization process in the vertical direction, a cover member 2 including an ink supply port 21 and a common ink chamber 22, and a nozzle plate 9 having nozzles 10, which members are bonded together to define ink channels 4. On the upper half portion of the channel wall 3, an electrode 5 is formed for application of an electric field. The rear end portion of the ink channel is formed in an R shape corresponding to a diameter of a dicing blade used for groove formation. The portion denoted by 6 has a shallow groove as an electrode connecting portion which is also formed by the dicing blade for connection with respect to an external portion. The electrode formed in shallow groove portion 6 is connected to an external electrode 8 such as a flexible printed circuit board at the rear end portion of shallow groove portion 6 by a bonding wire 7.

Now, a manufacturing method of the ink jet head shown in FIG. 20 will be described with reference to FIG. 21 and 22.

As shown in FIG. 21, a dry resist film 11 allowing a dicing process is laminated on a piezoelectric material 12 which has been vertically subjected to a polarization process.

Then, as shown in FIG. 22, a groove to be ink channel 4 as well as, shallow groove portion 6 (slope) are formed by the dicing blade. Thereafter, diagonal vapor deposition is performed in the A and B directions in FIG. 22, with the incident direction set in such a way that a metal to be an electrode adheres only to the upper half portion of channel wall 3. Then, dry resist film 11 is lifted off to provide a base material 1 as an actuator having a metal film 5 formed on the upper half portion of channel wall 3 and in shallow groove portion 6 as shown in FIG. 20.

Returning to FIG. 20, cover member 2 has ink supply port 21 and common ink chamber 22 which are formed by machining or sand blasting. If the sand blasting is employed, it may be performed after masking the portion excluding ink supply port 21 and common ink chamber 22 with a resist film or a metal mask.

If nozzle plate 9 is formed of a polymeric material, nozzles, each having a prescribed size, are formed by an excimer laser process Alternatively, nozzles may be formed in a metal material by punching or the like. Thus manufactured base member 1, cover member 2 and nozzle plate 9 are bonded together by an adhesive in a desired positional relationship.

Thus manufactured ink jet head has ink supply port 21 connected to an external ink storage tank (not shown) and common ink chamber 22 through which ink is supplied to the plurality of ink channels 4. The electrode formed on the upper half portion of channel wall 3 is connected at the R-shape portion of the ink channel rear end portion to provide the same potential in respective ink channel 4 and connected to external electrode 8 through shallow groove portion 6. The electrodes formed at respective ink channels 4 are individually connected to external electrode 8.

A voltage is applied by external electrode 8 such that a prescribed ink channel is selected in accordance with printing data and an electric field is applied in the direction orthogonal to the polarizing direction of channel wall 3. Channel wall 3 supplied with the voltage is subjected to shear deformation. As a result, pressure wave is caused in the ink channel to eject ink droplets from nozzle 10. Note that although in FIG. 20 the electrode connecting portion and the external electrode are connected by bonding wire 7, the connection may be made with use of an anisotropic conductive film (ACF) as is conventionally known.

A conventional ink jet head uses a metal film formed in shallow groove portion 6 as the electrode connecting portion. Thus, the metal film is positioned in the shallow groove. Further, the metal film is formed when forming the metal film to be the electrode on the upper half portion of channel wall 3. Thus, there is dry resist film 11 to be a mask at the portion excluding the shallow groove. As a result, a metal film of a sufficient thickness cannot be formed at the bottom of shallow groove portion 6 because of shadowing with diagonal vapor deposition.

The aforementioned problems are discussed in the following.

FIG. 23 is a cross sectional view of shallow groove portion 6 shown in conjunction with formation of the metal film. Assume that the width of the channel formed in base member 1, the depth of the channel, and the thickness of dry resist film 11 are respectively 81 $\mu$m, 300 $\mu$m, and 30 $\mu$m. Then, the incident angle for diagonal vapor deposition would be about 24° with respect to the normal line when forming the metal film on the upper half portion of the channel wall. In this case, diagonal vapor deposition would be performed on shallow groove portion 6 of FIG. 20 with the same incident angle as shown in FIG. 23. FIG. 24 is a photograph showing a cross section of the metal film formed on the shallow groove portion when the depth of the shallow groove portion, the thickness of the dry resist film, and the incident angle for diagonal vapor deposition with respect to the normal line are respectively 25 μm, 30 μm, and 24°. Note that FIG. 24 shows the metal film after the dry resist film is lifted off.

Referring to FIG. 24, with the depth of the shallow groove portion of 25 μm, in the middle of the shallow groove bottom, the metal film is formed to have a step in the region with a width of about 32 μm. Thus, in wire bonding, bonding must be made in the middle of the step. The positioning failure of the bonding wire with respect to the step causes falling or inclining of the wire, and therefore accurate positioning must be ensured.

The height electrode portion is smaller than that of base member 1. The smaller depth of the shallow groove portion provides the greater width of the metal film formed at the bottom of the groove portion. However, a depth of at least 10 μm is required for the shallow groove portion, taking into account machining accuracy and R of the edge portion of the dicing blade. This will be described in detail with reference to FIGS. 25A and 25B showing cross sections of the dicing blade. When dicing blade 30 is unused, it has a right-angled corner E as shown in FIG. 25A. As dicing blade 30 is used, it comes to have a rounded corner as shown in FIG. 25B. If use of dicing blade 30 as shown in FIG. 25B usually provides a shallow groove having a depth of 10 μm, actually, the dry resist film cannot be cut to have a width of no more than 60 μm. As a result, the width of the metal film in the shallow groove portion becomes smaller.

On the other hand, the use of the dicing blade as shown in FIG. 25A provides a shallow groove having an infinitely small depth. However, this leads to a higher production cost. Thus, the depth of the shallow groove portion must be at least 10 μm.

If the electrode of the electrode connecting portion is formed at the bottom of the shallow groove portion, bonding failure may occur when making a connection with respect to the external electrode by wire bonding. This will be discussed in detail with reference to FIG. 26 which shows a cross section of capillary 40 and bonding wire 50 used for wire bonding.

Referring to FIG. 26, capillary 40 has a concave shape facing downward to surround bonding wire 50 between both ends 41 of the capillary when viewed in section. The bonding wire generally has a diameter of about ϕ50 μm and capillary 40 has a width of about 100 μm. When wire bonding is performed with capillary 40 having the shape as shown in FIG. 26, the end (portion denoted by B) of the capillary is brought into contact with a convex portion (portion denoted by A) of base member on either side of shallow groove portion 6. As a result, ultrasonic energy for bonding would not be transferred to the wire efficiently. Thus, the bonding wire is not fully welded, deteriorating bonding of the wire and the metal film at the shallow groove portion. If the connection of the electrode connecting portion and the external electrode is made with use of an anisotropic conductive film (ACF), the presence of metal film in the concave portion of the electrode connecting portion results in connection failure.

Electrode surface can be made higher than the base member by increasing the thickness of the metal film of the electrode at the electrode connecting portion. However, as stated previously, since the depth of shallow groove portion 6 must be at least 10 μm, the metal film of at least 10 μm is required. This leads to a problem associated with production cost and time. Another conventional method of manufacturing an ink jet head involves formation of grooves in piezoelectric substrate 10 without using any dry resist film as shown in FIG. 20. In this method, the metal film formed on top of the upper portion of channel wall 3 and the metal film at the electrode connecting portion are individually removed by machining after the metal film is formed. In this case, although a convex portion can be formed on the electrode surface of electrode connecting portion 23, machining of the upper portion of the channel wall may destroy a channel wall, possibly reducing yield. Further, it is difficult to provide channel walls of the same height. In bonding cover member 2, it is not tightly bonded to the upper portion of channel wall 3, whereby ink leaks out from one channel to another.

As described above, the conventional ink jet head having the electrode of the electrode connecting portion at the bottom of the shallow groove portion suffers from the problem that connection failure occurs when making a connection to the external electrode by wire bonding or with use of an ACF. In addition, if the shallow groove at the electrode connecting portion is made to have a smaller depth, a dicing blade with a right-angled corner must be used, resulting in greater production cost.

Moreover, if the metal film on the upper portion of the channel wall is removed by machining and the electrode connecting portion is provided at the convex portion, destruction of the channel wall may occur leading to smaller yield. In addition, the variation in channel wall height causes ink to leak out from one channel to another.

SUMMARY OF THE INVENTION

The present invention is made to solve the aforementioned problems. An object of the present invention is to provide an ink jet head which has been improved to enable reliable connection of an external electrode without increasing production cost.

Another object of the present invention is to provide a manufacturing method of such an ink jet head.

The ink jet head according to one aspect of the present invention is provided with a base member which is at least partially formed of a piezoelectric material, which includes a plurality of first grooves formed in its surface, separated from one another by walls, and arranged in parallel, and which further includes electrodes respectively formed on parts of the walls of the first grooves. A cover member defining ink channels to be pressure chambers is provided on the base member to cover the plurality of first grooves. Nozzles communicate with the ink channels. A plurality of electrode connecting portions are provided in the surface of the base member electrically connected to the electrode for external connection. The ink jet head applies a driving voltage to the electrode to cause shear deformation of the wall, thereby causing pressure vibration to the ink channel to eject ink from the nozzles. The plurality of electrode connecting portions are electrically isolated from one another by the second grooves formed in the surface of the base member. The surface of the electrode connecting portion is substantially flush with the upper surface of the wall.

In this structure, since a metal film forming the electrode of the electrode connecting portion is substantially made flush with the upper surface of the wall in connecting the electrode connecting portion, used for supplying a voltage to a piezoelectric material of the ink jet head, to the external electrode, so that a reliable connection is made without causing connection failure by wire bonding or with use of an ACF.

In a preferred embodiment of the present invention, the end portion of the first groove on the side free from nozzles has a slope, on which the electrode connecting portion extends. The electrode and the electrode connecting portion are in electrical communication with each other through the extending portion.

In this structure, the electrode on the channel wall is individually connected to the metal film formed on the slope. In addition, the slope reduces the effect of shadowing during metal film formation, so that the metal film can be formed on the slope with a sufficient thickness. Since the electrode on the channel wall forming the ink channel is connected to the electrode connecting portion through the metal film on the slope, the electrodes formed on the channel walls are not subjected to short circuit, and a reliable connection is made without causing connection failure.

In a more preferred embodiment of the present invention, the sloped portion partially has a flat surface in the direction toward the nozzles, and a distance of the flat surface from the surface of the base member is at most 100 $\mu$m.

In this structure, when forming the metal film, the effect of shadowing is reduced and the metal film to be the electrode is formed at the bottom of the slope, whereby a reliable electrical connection of the electrode connecting portion and the electrode formed on the channel wall is ensured.

In a more preferred embodiment of the present invention, each electrode connecting portion extends in the direction away from the nozzles starting from the slope.

In this structure, the region separating the electrode connecting portions is in the region of the slope, so that the electrodes formed on the channel walls are isolated to prevent short circuit while being connected to the electrode connecting portions. When grooves are formed for isolating the electrode connecting portions, the groove portions do not reach the channel wall regions. Thus, the strength of the channel wall is not reduced.

In a more preferred embodiment of the present invention, the electrode connecting portion at the slope portion has a length of at least 50 $\mu$m.

In this structure, a region separating the electrode connecting portions is in the region of the slope while being electrically connected to the electrode on the channel wall over a distance of at least 50 $\mu$m. Thus, the electrodes on the channel walls are reliably isolated to prevent short circuit while being connected to the electrode connecting portions.

In a more preferred embodiment of the present invention, the electrode connecting portion has a width of at least 40 $\mu$m and at most 100 $\mu$m.

In this structure, since the electrode connecting portion for connection to the external electrode has a width of at least 40 $\mu$m and at most 100 $\mu$m, a reliable electrical connection can be made by wire bonding or with use of an ACF.

A method according to the second aspect of the present invention refers to a method of manufacturing an ink jet head including: a base member at least partially formed of a piezoelectric material, including a plurality of first grooves formed in its surface, separated by walls and arranged in parallel, and including an electrode on parts of the walls of the first grooves; a cover member formed to cover the plurality of grooves of the base member to provide ink channels of a pressure chamber; and nozzles provided in communication with the ink channel, where a driving voltage is applied to the electrode to cause shear deformation of the wall and pressure vibration to the ink channel to allow ink to eject from the nozzles. First of all, a substrate at least partially formed of the piezoelectric material is prepared. Grooves are formed in the surface of the substrate with use of a resist having a prescribed pattern, so as to form an ink channel of the first groove having one end portion, on the side opposite the nozzles, formed with a slope. A metal film is formed on the slope and the substrate excluding the bottom portion of the ink channel. The metal film is divided into a plurality of portions, so that a plurality of electrically isolated electrode connecting portions are formed.

In this structure, the metal film can be formed with the electrode connecting portion to be connected to the external electrode not covered with a polymeric material by means of wire bonding or with use of an ACF. Thus, the unwanted effect of shadowing is not produced in forming the metal film, so that the metal film with a sufficient thickness can be provided. Further, after the metal film is formed, the electrode connecting portions are isolated. Thus, a convex portion is readily provided at the electrode portion of the electrode connecting portion, whereby a reliable connection is made in connecting the external electrode by wire bonding or with use of an ACF.

In a preferred embodiment of the present invention, a boundary of the region covered with the resist and that not covered with the resist is a region of the slope.

In this structure, since the boundary of the regions covered and not covered with the polymeric material is in the region of the slope, unwanted shadowing is not caused to the region not covered with the polymeric material in the region of the slope, when forming the metal film. Thus, the metal film can be formed with a sufficient thickness and an electrical connection of the electrode on the channel wall and the electrode connecting portion is ensured.

In a more preferred embodiment of the present invention, the isolation of the electrode connecting portions involves physical removal of portions of the metal film and the base member and formation of the second grooves.

In this structure, after the metal film is formed on the base material, grooves for isolating the electrode connecting portions are formed. Thus, the electrode surface of the electrode connecting portion can be readily provided with a convex portion and a reliable isolation of the electrodes of the electrode connecting portions is enabled since the grooves are physically formed.

In a more preferred embodiment of the present invention, the second groove for isolating the electrode connecting portions extends to the upper surface of the wall.

In this structure, the grooves for isolating the electrode connecting portions are also positioned in the region covered with the polymeric material, so that the electrodes on the channel walls preliminary isolated by the polymeric material, the electrodes on the slopes that are connected separately from the electrodes on the channel walls, and the electrode connecting portions connected to the external electrode are respectively connected together. Thus, the electrodes on the channel walls are reliably connected to the external electrode without causing short circuit.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Now, embodiments of the present invention will be described in detail with reference to FIGS. 1 to 19.

First Embodiment

Figure 1:
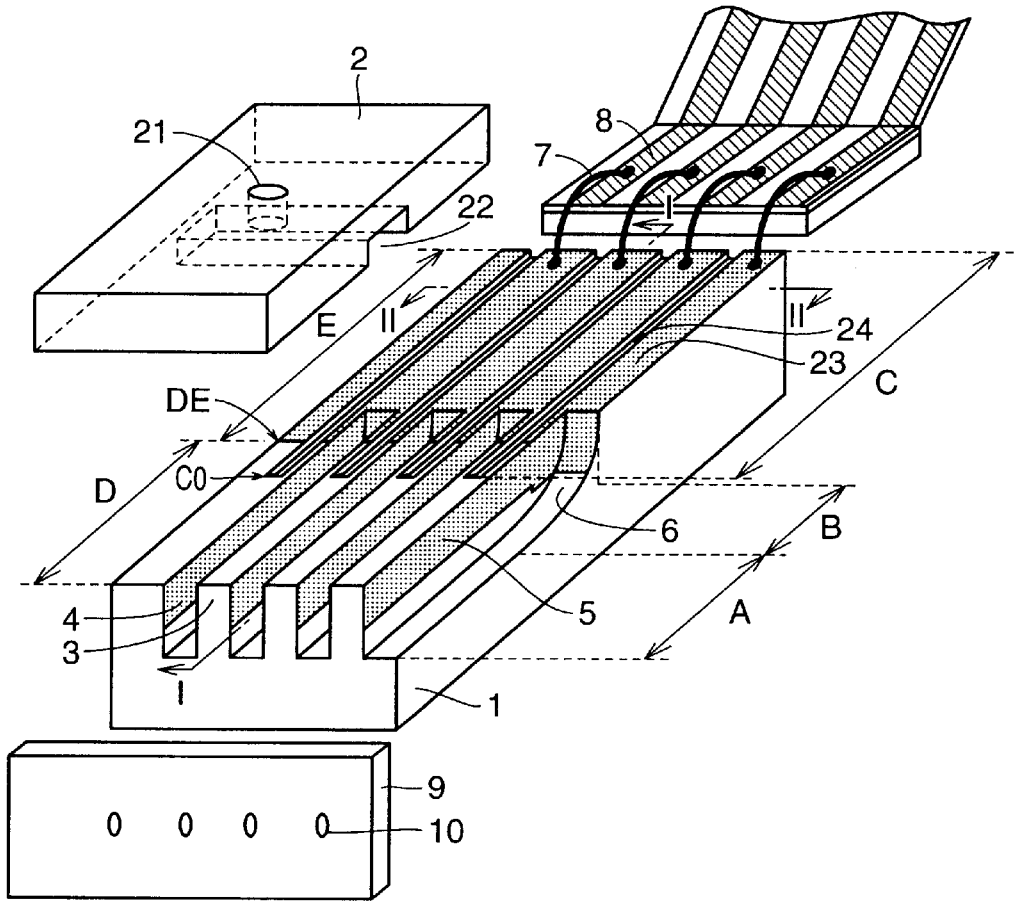
FIG. 1 is a perspective view showing an ink jet head according to a first embodiment of the present invention.
Figure 2:
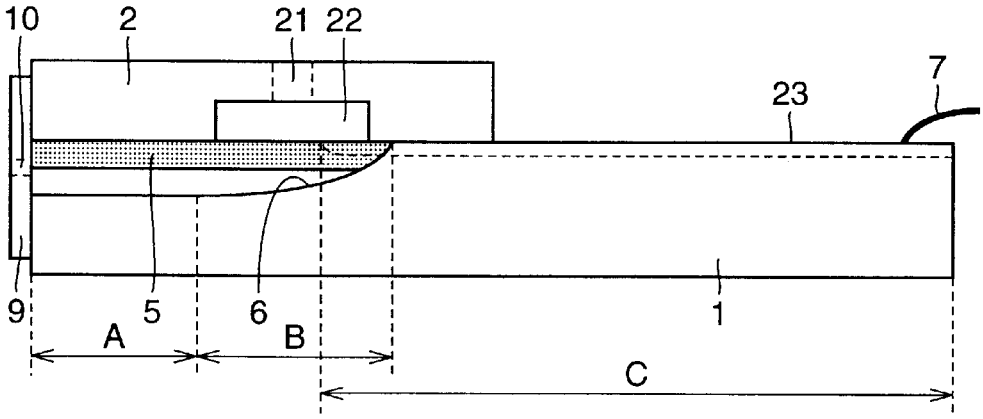
FIGS. 2 and 3 are cross sectional views showing the ink jet head according to the first embodiment of the present invention.

FIG. 1 is a perspective view showing the structure of an ink jet head according to the first embodiment of the present invention. FIG. 2 is a cross sectional view taken along the line I—I in FIG. 1.

Referring to FIGS. 1 and 2, the ink jet head includes a base member 1 having a plurality of grooves formed in a piezoelectric material which has been subject to a polarizing process in the vertical direction, a cover member 2 provided with an ink supply port 21 and a common ink chamber 22, and a nozzle plate 9 having nozzles 10. Base member 1, cover member 2, and nozzle plate 9 are bonded together to provide an ink channel 4 which is to be filled with ink.

Channel wall 3 has on both sides metal films as electrodes 5 used for applying an electric field in the direction orthogonal to the polarizing direction of the piezoelectric member. Ink channel 4 has a constant depth of 300 $\mu$m in the region denoted by A, having a width of 80 $\mu$m and a length of 3 mm.

In the region denoted by B, the depth of the groove is gradually reduced. The length of region B is uniquely determined by the diameter of a dicing blade used for groove formation and the depth of region A. In the present embodiment, since the dicing blade has a diameter of 52 mm, the length of region B is about 3.9 mm. The metal film forming electrode 5 is formed on the upper surface of base member 1 on the side of the electrode connecting portion within region B.

In the region denoted by C, a groove 24 for isolating electrodes is formed between ink channels, having a depth of 30 $\mu$m, width of 50 $\mu$m, and length of 6 mm. In the present embodiment, grooves 24 extend into the region denoted by D, over the length of 2 mm. Here, region D refers to the region free from the metal film of the upper portion of channel wall 3 as will later be described with reference to FIG. 11. The region denoted by E refers to the region with the metal film of the upper portion of channel wall 3. Further, the boundary of regions D and E is denoted by DE.

Ink channel 4, shallow groove portion 6 (a slope portion), and a groove 24 for isolating the electrodes are formed in parallel with a pitch of 141 $\mu$m. If the depth of groove 24 for isolating the electrodes is too small, short circuit may occur between the adjacent electrodes. However, groove 24 needs not have an unnecessarily large depth. In the present embodiment, groove 24 has a depth of 30 $\mu$m.

Electrode 5 formed on the upper half portion of channel wall 3 in each ink channel is individually connected to an electrode connecting portion 23 through shallow groove portion 6 for external connection to an external electrode 8 by a bonding wire 7. Note that, in the present embodiment, the metal film is formed by vapor deposition of Al, having a thickness of 1.2 $\mu$m at the side surface portion of channel wall 3 and a thickness of 4 $\mu$m at electrode connecting portion 23. Any conductive material such as Cu, Ni, and Ti may be used instead of Al. The metal film is formed over the entire upper surface of base member 1 in the region on the side of external electrode connection not extending beyond DE before the electrode connecting portions are isolated by grooves 24.

Figure 3:
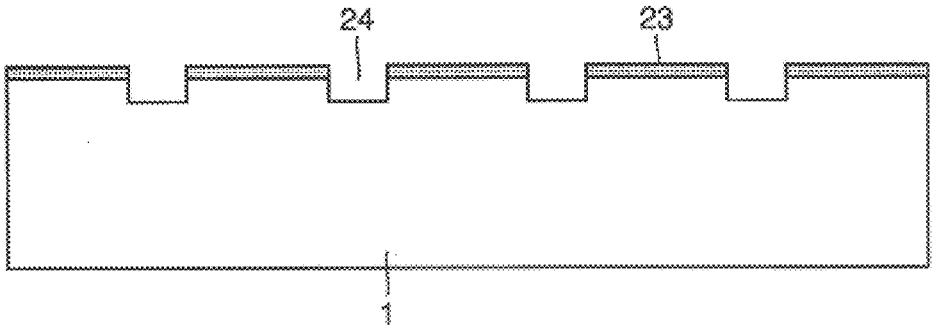

FIG. 3 shows a cross sectional view taken along the line II—II of FIG. 1.

Figure 26:
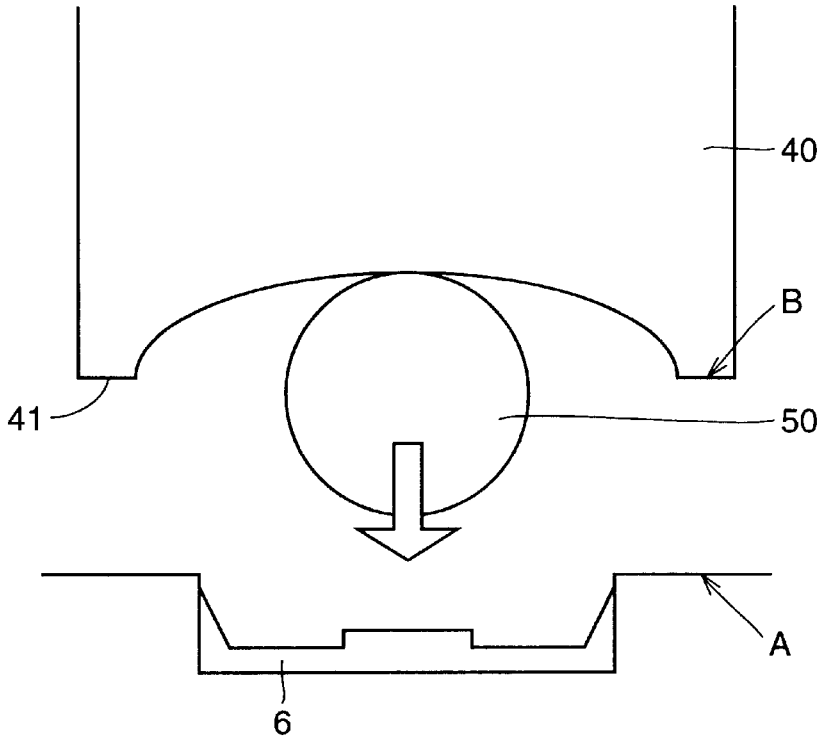
FIG. 26 PRIOR ART
FIG. 26 is a cross sectional view shown in conjunction with a wire bonding method for the electrode connecting portion of the conventional ink jet head.

Referring to FIG. 3, since electrode connecting portions 23 are isolated by grooves provided between the ink channels, they are formed at the convex portions of base member 1. The convex portion has a width of 91 $\mu$m (=141–50 $\mu$m). Note that if the width of the convex portion is 40 $\mu$m or smaller, a connection failure may occur when connecting by wire bonding or with use of an ACF. If the width of the convex portion is 100 $\mu$m or greater, for example when the pitch of the ink channel is 141 $\mu$m, the grooves for isolation must have a width of 41 $\mu$m (=141–100 $\mu$m) or smaller. This makes processing difficult. If the electrode connecting portion in such a shape is connected to the external electrode by wire bonding, the electrode surface of the electrode connecting portion comes to have a convex shape having a width of 91 $\mu$m. As a result, a bonding capillary does not contact both sides of the electrode surface as in FIG. 26 of the prior art example, and ultrasonic energy for bonding can be efficiently transferred to the bonding wire. Consequently, the problem of connection failure is eliminated and a reliable connection can be made.

Figure 4:
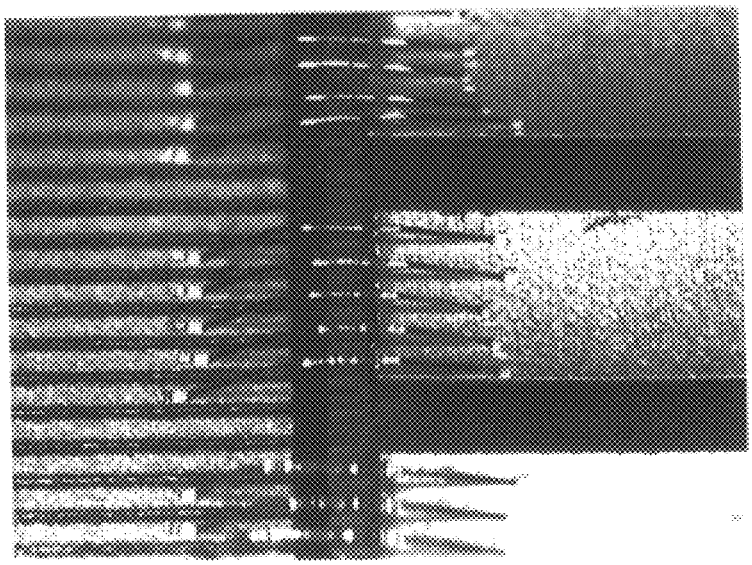
FIG. 4 is a photograph of the ink jet head of the present invention shown in conjunction with a connection to an external electrode by wire bonding.

FIG. 4 is a photograph of the bonding portion when the connection to the external electrode is made by wire bonding with the electrode connecting portion in the convex shape according to the present invention. Note that in FIG. 4, the external electrodes are not isolated to provide better clarity of the wire bonding portion to the electrode connecting portion.

Referring to FIG. 4, it can be seen that the provision of the electrode of the electrode connecting portion at the convex portion prevents the connection failure, providing wire bonding to the electrode connecting portion and a reliable connection. In the present invention, the connection to the external electrode is made by wire bonding. Alternatively, if the connection is made by the ACF, a reliable connection is enabled without causing connection failure because of the electrode of the electrode connecting portion provided at the convex portion.

This will be discussed with reference to FIGS. 5 and 6.

Figure 5:
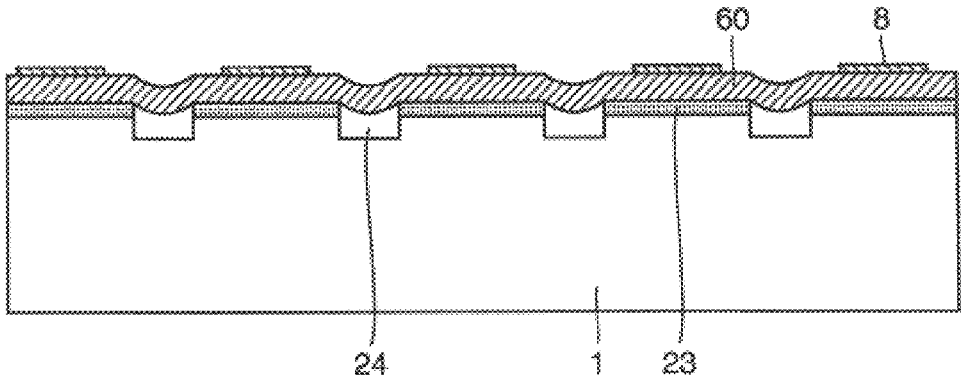
FIG. 5 is a cross sectional view of the ink jet head of the present invention shown in conjunction with a connection with use of an ACF.
Figure 6:
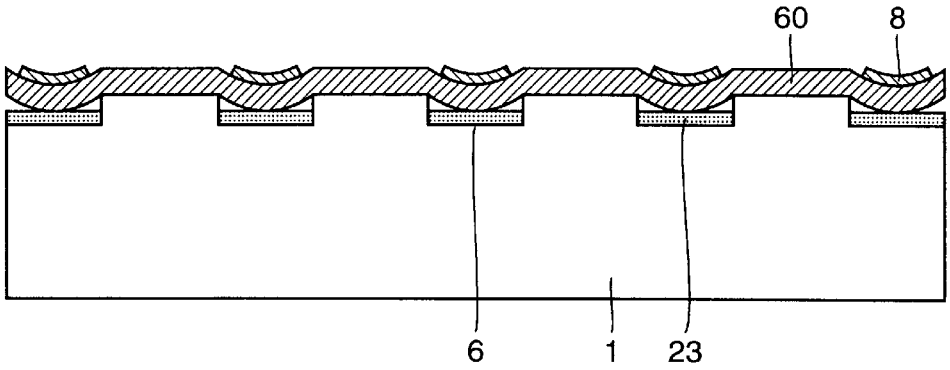
FIG. 6 PRIOR ART
FIG. 6 is a cross sectional view of a conventional ink jet head shown in conjunction with a connection with use of an ACF.

FIG. 5 relates to the case where the electrode connecting portion of the present invention is bonded to external electrode 8 with use of an anisotropic conductive film (ACF) 60. FIG. 6 relates to the case where conventional electrode connecting portion 23 is bonded to external electrode 8 with use of ACF 60. In the conventional ink jet head with the electrode of electrode connecting portion 23 provided in the concave portion, as shown in FIG. 6, the ACF must be deformed into the concave portion in connecting the ACF and the electrode connecting portion, possibly causing connection failure. On the other hand, in the ink jet head of the present invention, electrode connecting portion 23 is provided at the convex portion. Thus, as shown in FIG. 5, ACF 60 is reliably connected to the electrode connecting portion.

As described above, in the ink jet head of the present invention, the electrode of the electrode connecting portion is provided at the convex portion so that the connection to the external electrode can be made without causing connection failure by wire bonding or with use of the ACF. In addition, ejection failure does not occur at every ink channel.

Note that the depth, length and width of region A of the ink channel, the length of region B, and the depth, length and width of region B are not limited to those of the present embodiment. Further, although in the present embodiment a piezoelectric material which has been subjected to the polarizing process in the vertical direction is used as base member 1, a composite piezoelectric material having a channel wall of which only upper half portion has been subjected to the polarizing process in the vertical direction may be employed.

Second Embodiment

Figure 7:
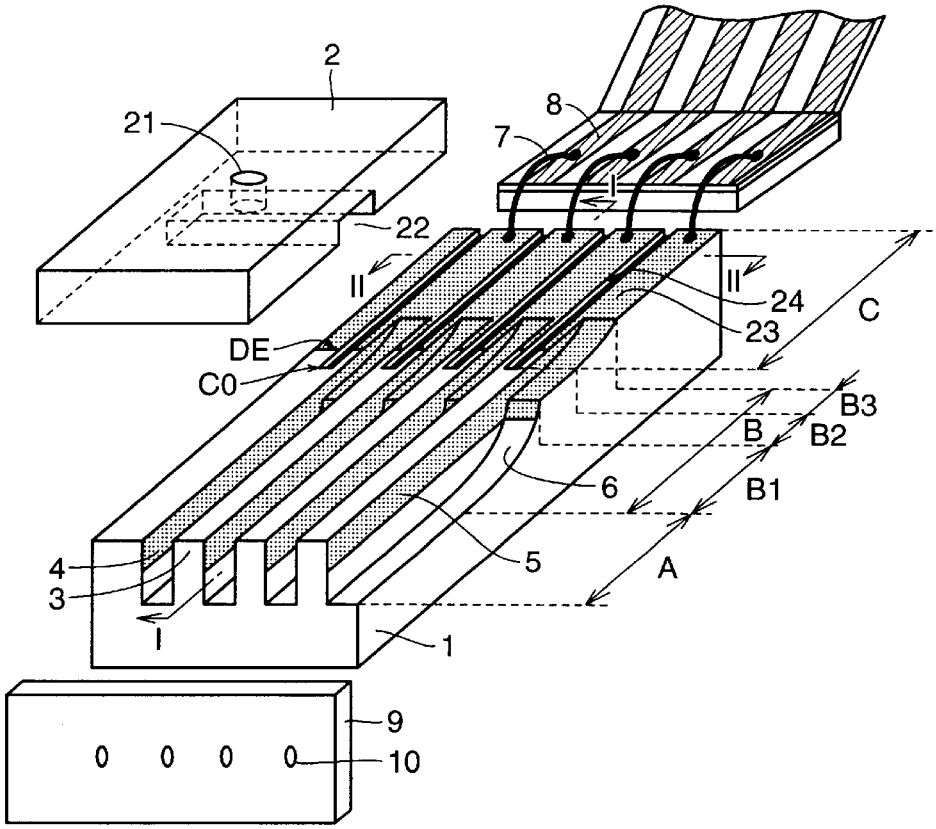
FIGS. 7 to 9 are cross sectional views showing an ink jet head according to a second embodiment of the present invention.

FIG. 7 is a perspective view showing the structure of an ink jet head according to the second embodiment of the present invention. FIG. 7 is a cross sectional view taken along the line I—I of FIG. 7.

Figure 8:
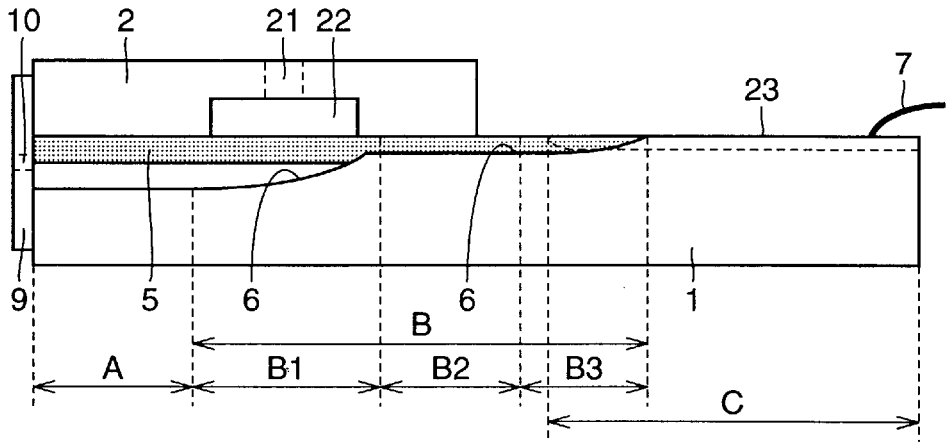

Referring to FIGS. 7 and 8, the ink jet head includes a base member 1 having a plurality of grooves 4 formed in a piezoelectric material which has been subjected to a polarizing process in the vertical direction, a cover member 2 having an ink supply port 21 and a common ink chamber 22, and a nozzle plate 9 having nozzles 10. Base member 1, cover member 2 and nozzle plate 9 are bonded together to provide ink channels 4 which will be filled with ink. Channel wall 3 has on both sides electrodes 5, used for applying an electric field in the direction orthogonal to the polarizing direction of the piezoelectric material, at its upper half portions. Ink channel 4 has a constant depth of 300 $\mu$m in region A, having a width of 80 $\mu$m and a length of 3 mm. In the region denoted by B1, the depth of the groove gradually decreases. In the region denoted by B2, the groove has a depth of 50 $\mu$m and a length of 2 mm. In the region denoted by B3, as in region B1, the depth of the groove gradually decreases. The lengths of regions B1 and B3 are uniquely determined based on the diameter of a dicing blade used for groove formation and the depths of regions A and B2. However, in the present embodiment, the diameter of the dicing blade is 52 mm, so that the lengths of regions B1 and B3 are respectively about 3.6 mm and 1.6 mm. In region C, grooves 24 for isolation of the electrodes are formed between ink channels, each having a depth of 30 mm, width of 50 mm and length of 5 mm. Grooves 24 are formed to extend into region B2 or B3.

In the present embodiment, the grooves are formed to extend into regions B2 and B3 over a distance of 0.4 mm. Ink channels 4, shallow groove portions 6 formed of regions B1, B2 and B3, and grooves 24 for isolation of the electrodes are formed in parallel with a pitch of 141 $\mu$m. If the depth of region B2 is greater than 100 $\mu$m, the shadowing effect during formation of the metal film becomes more significant, whereby the metal film cannot be formed over a sufficient area and connection failure occurs. Thus, the depth of region B2 must be set to at most 100 $\mu$M. If the depth of groove 24 for isolation of the electrodes is small, short circuit may be caused between adjacent electrodes. However, the depth of groove 24 needs not be unnecessarily large and is 20 $\mu$m in the present embodiment.

The metal film is formed in the shadowed region of FIGS. 7 and 8. The electrode formed on the upper half portion of channel wall 3 within respective ink channel is connected to electrode connecting portion 23 individually through shallow groove portion 6 and then externally connected to external electrode 8 by bonding wire 7.

In the present embodiment, the metal film is formed by vapor deposition of Al, having a thickness of 1.2 $\mu$m at the side surface portion of channel wall 3, and a thickness of 4 $\mu$m at electrode connecting portion 23. Any conductive material such as Cu, Ni, and Ti may be used instead of Al. The metal film is formed over the entire upper surface of base member 1 in the region on the side of the external electrode connection not extending beyond BE before the electrode connecting portions are isolated.

In the present embodiment, regions B2 and B3 of shallow groove portion 6 and region C of groove 24 for isolation of electrodes are formed to overlap with each other over a distance of 2 mm. Thus, an end C0 of groove 24 for isolation of the electrodes is positioned in region B. If the overlapping distance is 50 $\mu$m or smaller, end BE of the metal film formed over the entire surface and end BE of groove 20 must be positioned with a precision of 50 $\mu$m or smaller. If the processing precision decreases even if only slightly, it becomes difficult to isolate the electrodes of the ink channels for external connection.

Figure 9:
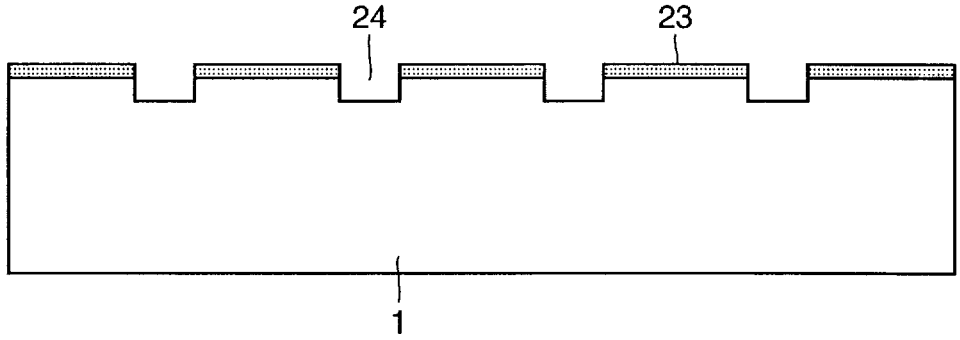

FIG. 9 is a cross sectional view taken along the line II—II of FIG. 7. Referring to FIG. 9, electrode connecting portions 23 are isolated by the grooves formed between ink channels 4. Thus, electrode connecting portions 23 are formed at the convex portions of base member 1. The electrode connecting portion has a width of 91 $\mu$m. When a connection of the electrode connecting portion in such a shape and the external electrode is made by wire bonding, since the electrode surface of the electrode connecting portion has a convex shape with a width of 91 $\mu$m, the bonding capillary does not contact with both sides the electrode surface as in FIG. 26 of the prior art example, and ultrasonic energy for bonding can be transferred efficiently to the bonding wire. Consequently, connection failure is avoided and a reliable connection is enabled.

In the present embodiment, a connection to the external electrode is made by wire bonding by way of example. If a connection is made with use of an ACF, the provision of the electrode of the electrode connecting portion at the convex portion prevents connection failure, enabling a reliable connection.

As described above, in the ink jet head of the present invention, since the electrode of the electrode connecting portion is provided at the convex portion, if a connection to the external electrode is made by wire bonding or with use of the ACF, a reliable connection is enabled without causing connection failure. In addition, ejection failure is prevented at each ink channel. Note that the depth and length of region A of the ink channel, as well as the depths and lengths of regions B1, B2, B3 and C are not limited to those of the present embodiment.

Third Embodiment

Figure 10:
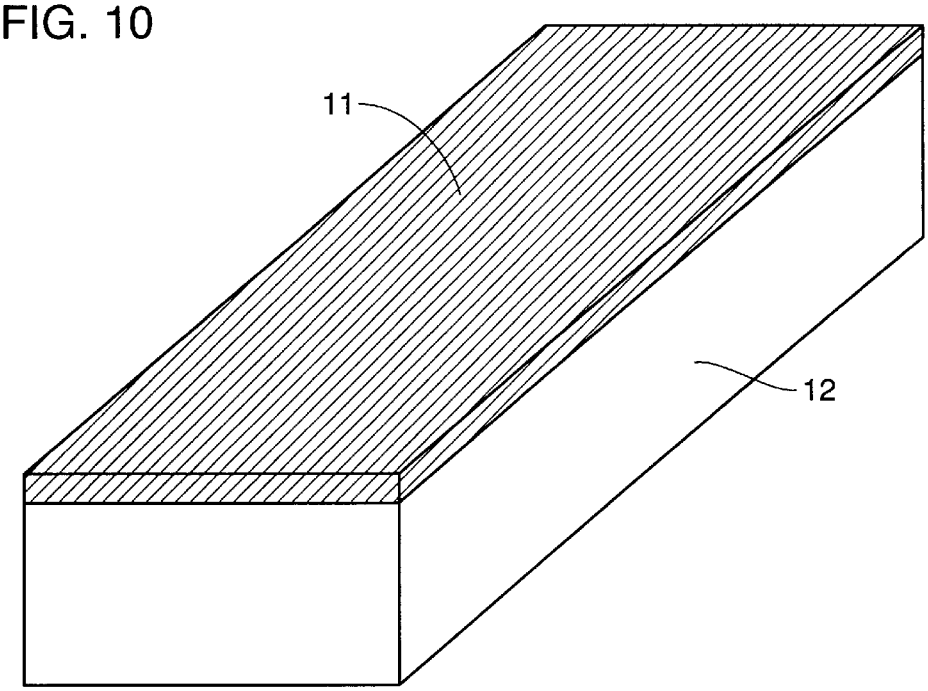
FIGS. 10 to 14 are perspective views respectively shown in conjunction with first to fifth steps of a method of manufacturing an ink jet head according to a third embodiment of present invention.

FIGS. 10 to 14 are shown in conjunction with a method of manufacturing an ink jet head of the present invention. FIG. 10 shows a piezoelectric substrate 12 which has been subjected to a polarizing process in the vertical direction, on which a dry resist film 11 is formed by a film laminator.

Figure 11:
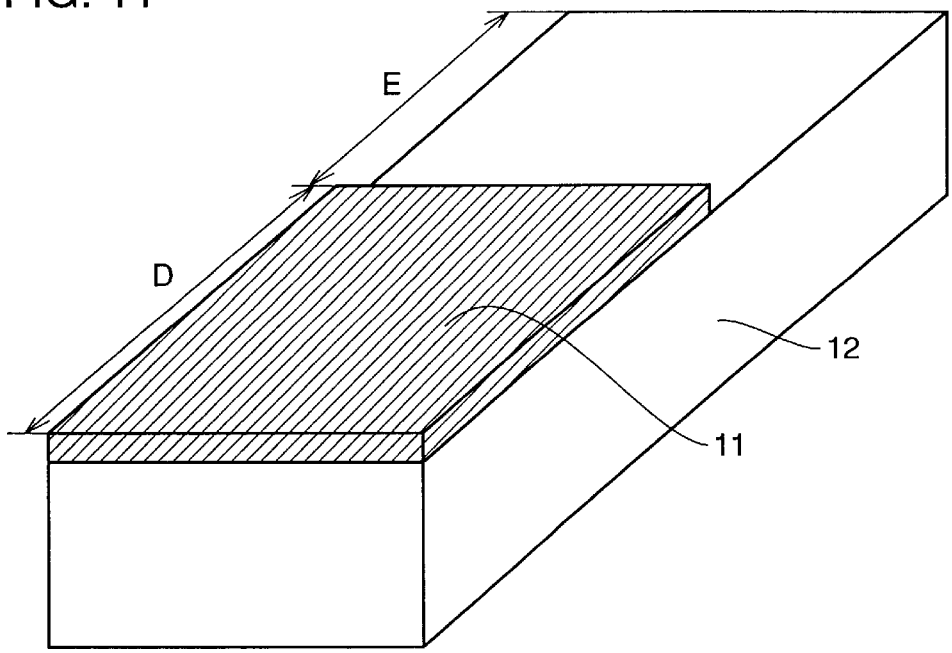
Figure 12:
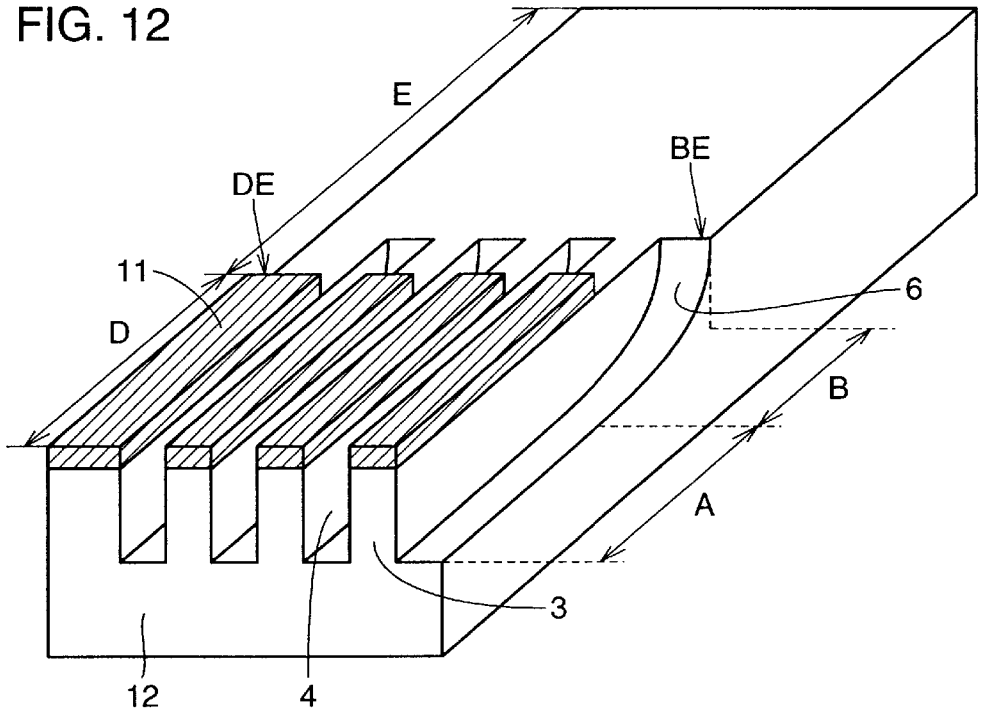

Piezoelectric material 12 may be formed for example of a PZT. Dry resist film 11 is a dry resist film (product name ALPHO NIT625) manufactured by The Nippon Synthetic Chemical Industry Co., Ltd., having a thickness of 30 $\mu$m. Piezoelectric substrate 12 with dry resist film 11 is patterned to have a shape as shown in FIG. 11 by exposure, development and so on. The exposure is performed with use of a photomask with an exposure amount of 400 mJ/cm$^2$. The development is performed for two minutes with use of 1 wt % sodium carbonate. Then, piezoelectric substrate 11 with patterned dry resist film is subjected to a groove process by a dicing saw, and an ink channel 4 and shallow groove portion 6 as shown in FIG. 12 are formed. The groove process is performed with use of a diamond blade (manufactured by Disco corporation) having a thickness of 75 $\mu$m and a diameter of $\phi$52 mm. The groove has a pitch of 141 $\mu$m and the groove width (ink channel width) and depth after the process are respectively 80 $\mu$m and 300 $\mu$m. In the region denoted by B, the depth of the groove gradually decreases. In the present embodiment, region B has a length of about 3.9 mm. Note that in dicing to form-shallow groove 6, end BE needs only be positioned closer to the rear end of piezoelectric material than end DE of dry resist film 11. In the present embodiment, the distance between BE and DE is 2 mm. Thereafter, a dry resist film is formed and the piezoelectric material with grooves is provided with metal film 5 by diagonal vapor deposition on the upper half portions of channel walls 3. At the time, the metal film is formed over the entire region E, and the metal films formed in respective ink channels are not electrically isolated.

Figure 13:
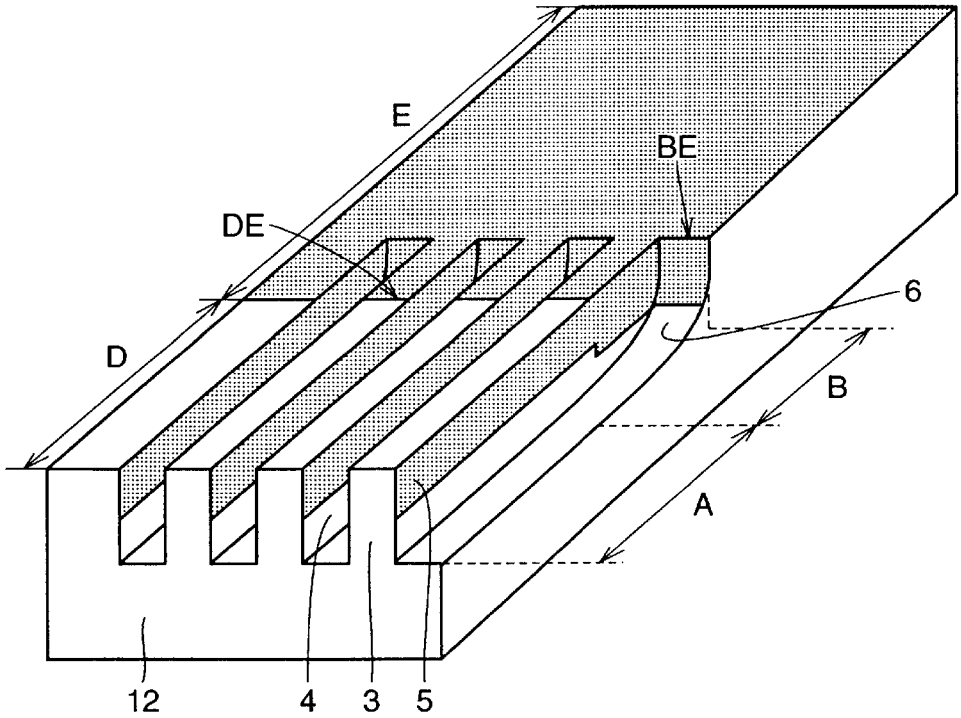

Then, dry resist film 11 is lifted off along with the metal film formed on dry resist film 11 to provide a base member 1 having metal film 5 as shown in FIG. 13. In FIG. 13, electrodes 5 formed on the channel walls are not isolated but are electrically connected through the metal film formed in region E.

Figure 14:
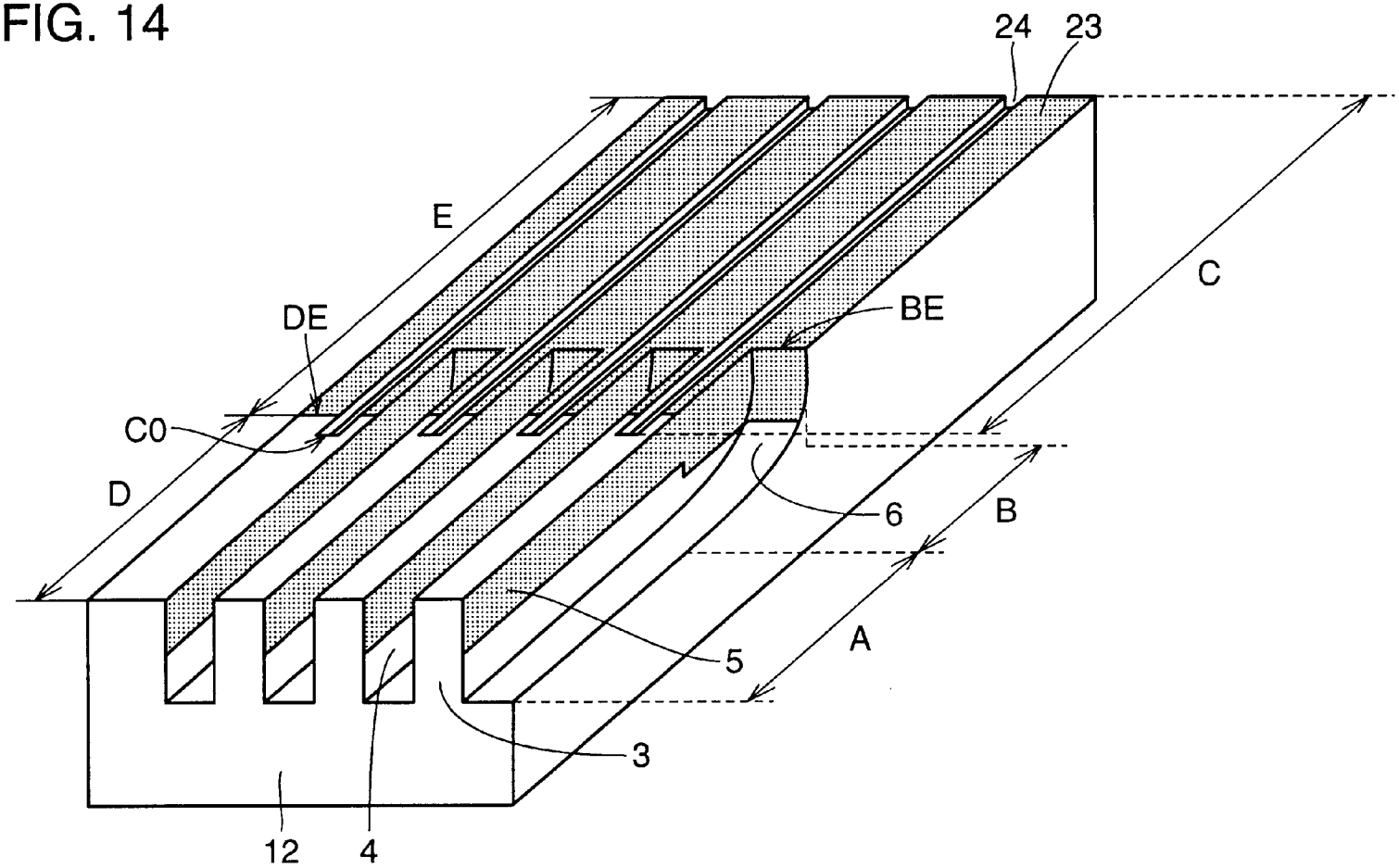

Then, as shown in FIG. 14, grooves 24 are formed between ink channels 4 by dicing in region 4 having on its entire surface the metal film and in the part of region B formed with shallow groove portion 6. Thus, electrode connecting portions 23 individually connected to the ink channels are formed. Grooves 24 for forming electrode connecting portion 23 is processed with use of a dicing blade having a width of 45 $\mu$m to have a width of 50 $\mu$m and depth of 30 $\mu$m. Groove 24 is formed such that end C0 is positioned in region D. Thus, electrodes 5 formed of metal films in respective ink channels are reliably isolated without causing short circuit and connected to electrode connecting portions 23.

As described above, in the method of manufacturing the ink jet head of the present invention, the metal film to be the electrodes are formed in the entire region to be the electrode connecting portion and then grooves for isolation of the electrodes are formed. Thus, the electrode of the electrode connecting portion can be formed at a convex portion and, in connecting to the external electrode, a connection is reliably made without causing connection failure by means of wire bonding or with use of an ACF. Further, base member 1 maintains planarity of piezoelectric material 12 at the upper portion of the channel wall, so that a reliable bonding is enabled when bonding cover member 2 and ink leakage is prevented between adjacent ink channels.

Fourth Embodiment

Figure 15:
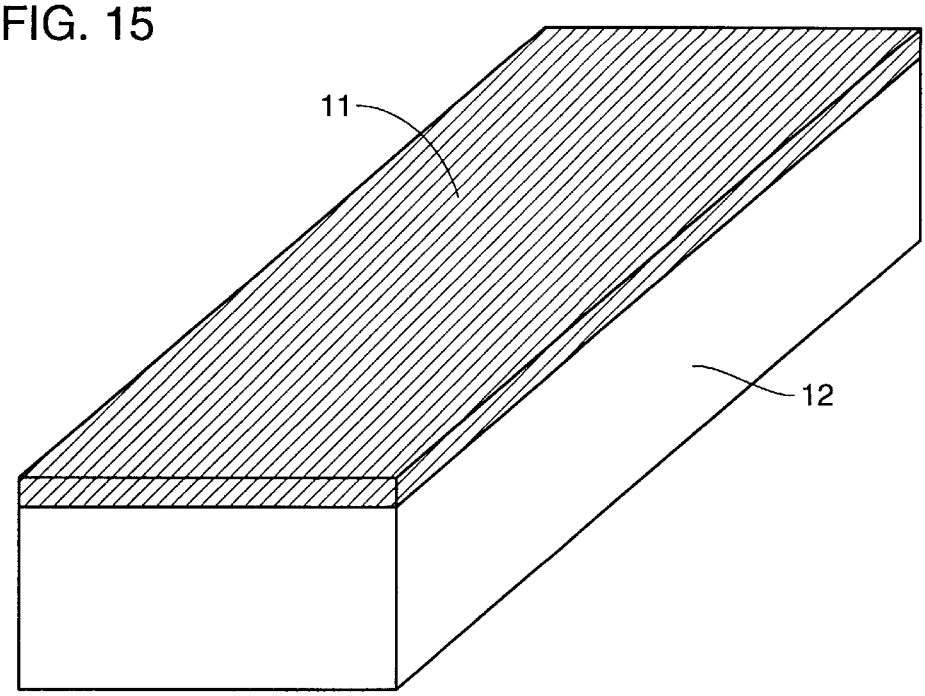
FIGS. 15 to 19 are perspective views respectively shown in conjunction with first to fifth steps of a method of manufacturing an ink jet head according to a fourth embodiment of the present invention.
Figure 16:
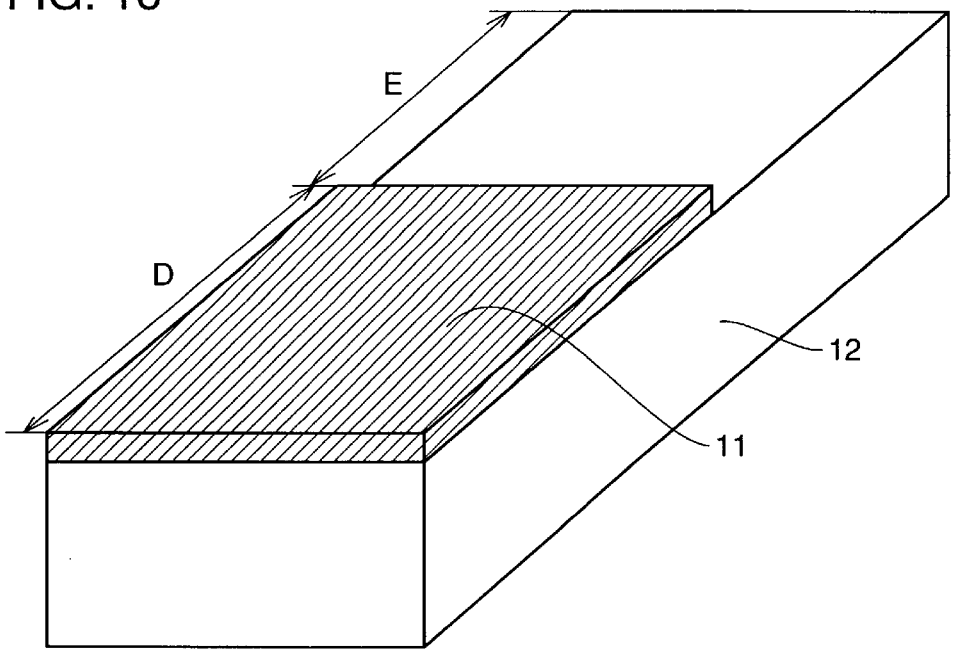
Figure 17:
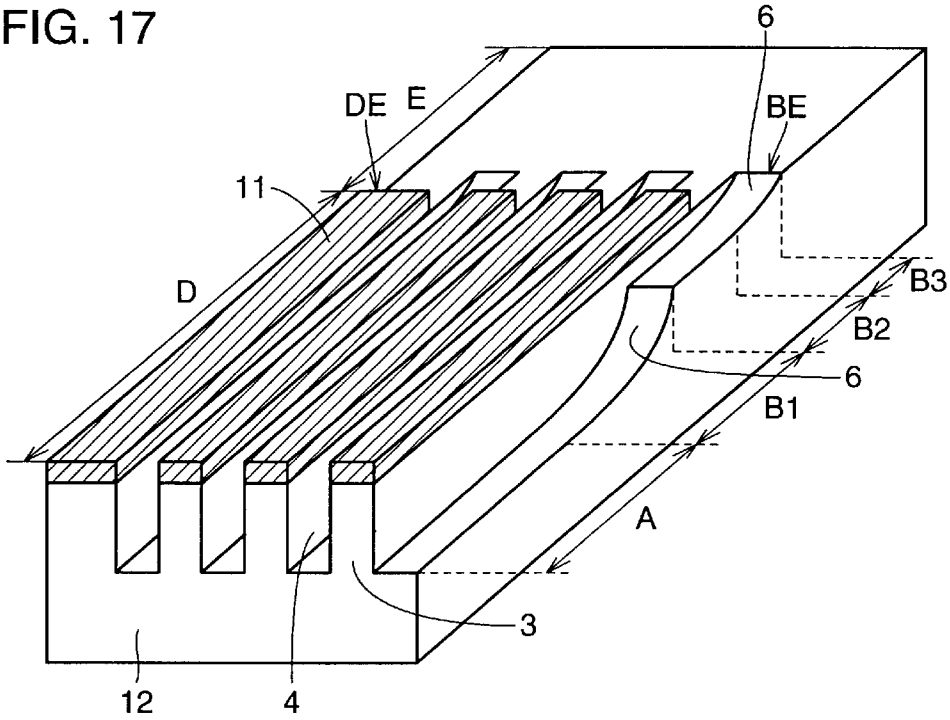

FIGS. 15 to 19 are shown in conjunction with a method of manufacturing an ink jet head of the present invention. FIGS. 15 and 16 are the same as those of the third embodiment, and therefore detailed description will not be given here. Piezoelectric substrate 12 formed with a patterned dry resist film is subjected to a groove process by a dicing saw, and ink channels 4 and shallow groove portions 6 are formed as shown in FIG. 17. The groove process is performed with use of a diamond blade (Disco corporation) having a thickness of 75 $\mu$m and diameter of $\phi$51 mm to provide grooves with a pitch of 141 $\mu$m. The groove width (ink channel width) after the process is 80 $\mu$m. In the region denoted by A, the groove has a constant width, having a depth of 300 $\mu$m and length of 3 mm.

Shallow groove portion 6 is formed as in the case of the ink channel. The depth of region B1 gradually decreases. Region B2 has a constant depth of 50 $\mu$m and has a length of 2 mm.

Like region B1, the depth of region B3 gradually decreases. End BE of shallow groove portion 6 is closer to the rear end than end DE of dry resist film 11. In the present embodiment, the distance between BE and DE is 2 mm.

Successively, a dry resist film is formed, and piezoelectric material 12 which has been subjected to the groove process is provided with metal film 5 on the upper half portion of channel wall 3 by diagonal vapor deposition. At the time, the metal film is formed over the entire region E, and the metal films formed in respective ink channels are not electrically isolated. Then, dry resist film 11 is lifted off along with the metal film formed on dry resist film 11 to provide base member 1 with metal film 5 as shown in FIG. 18.

Figure 18:
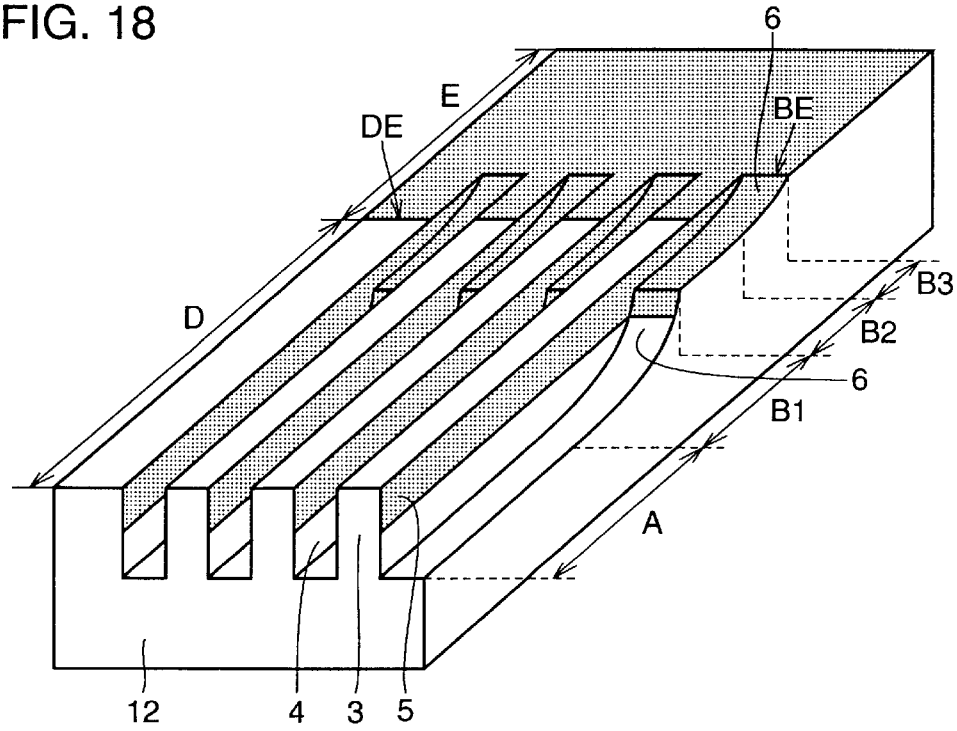
Figure 19:
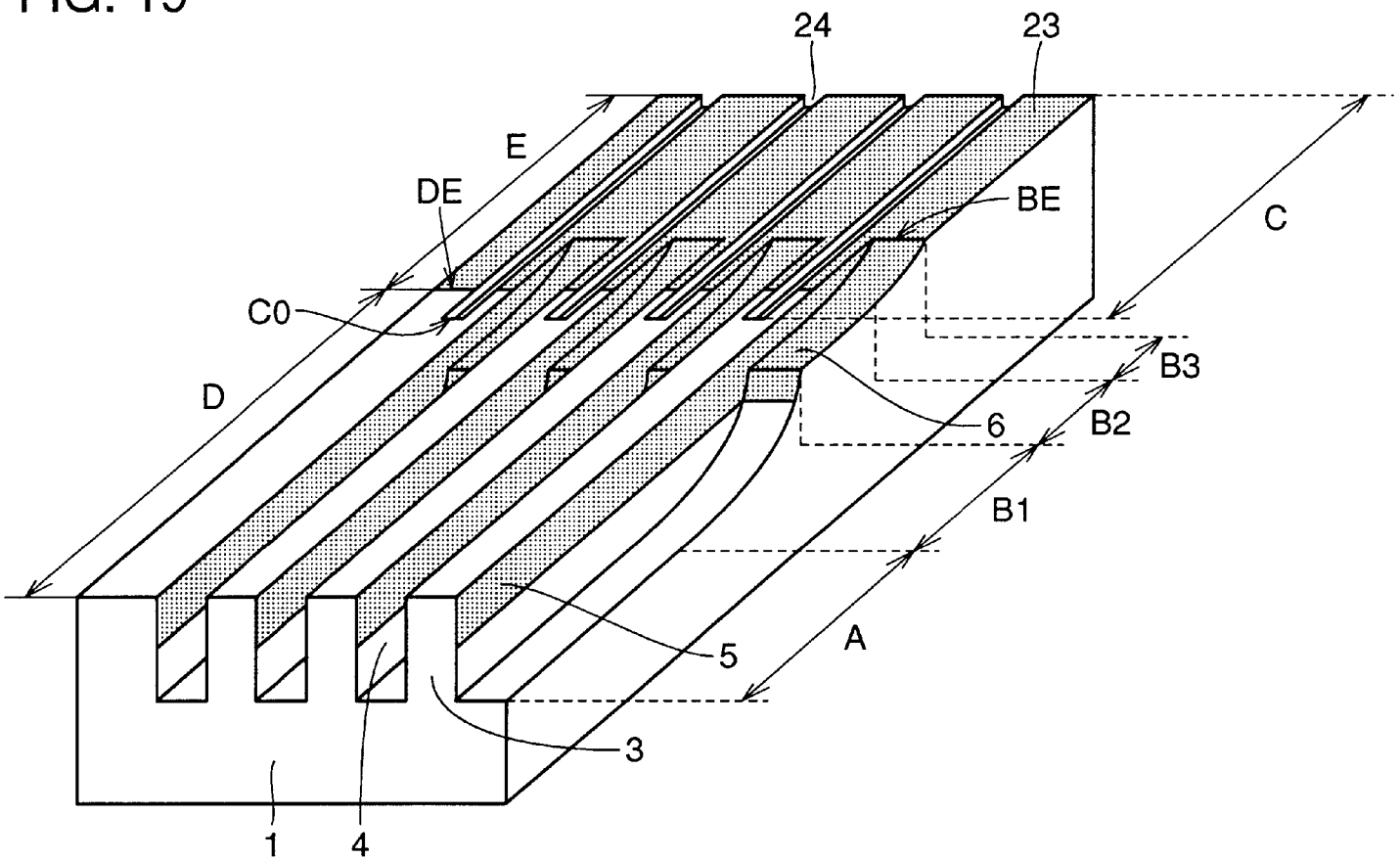
Figure 20:
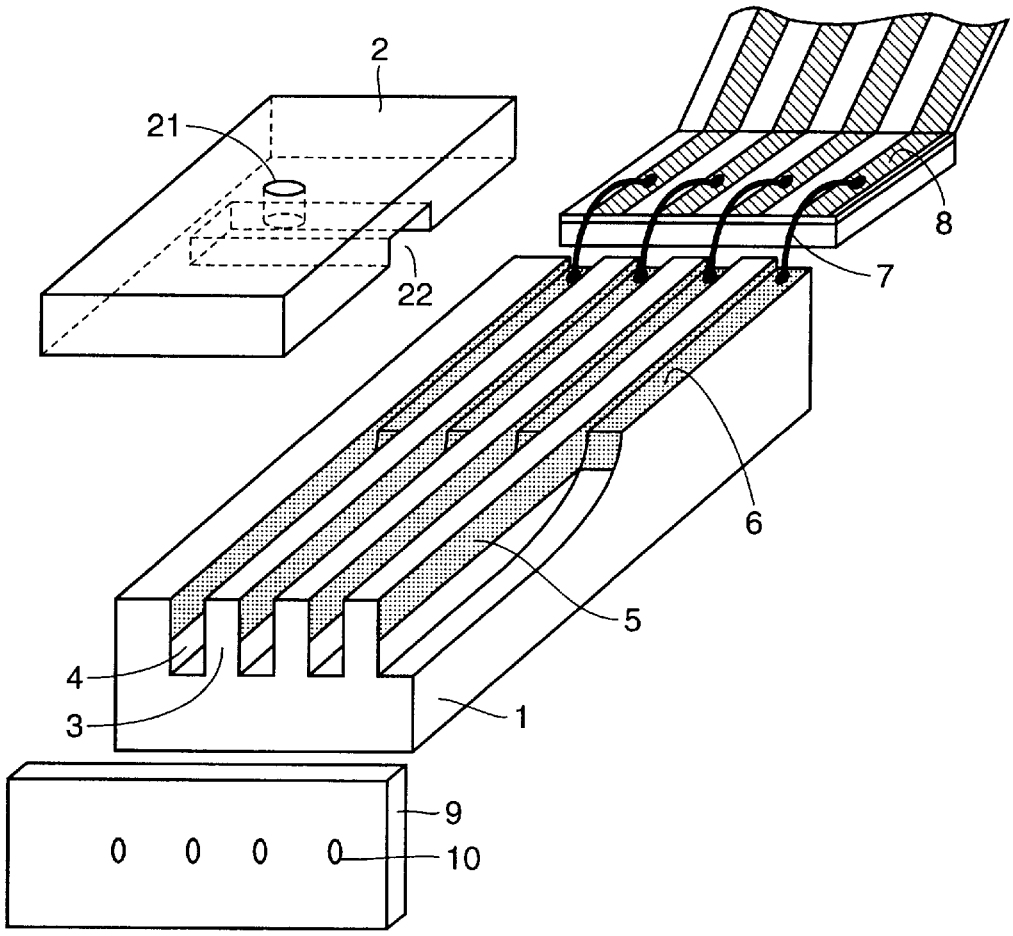
FIG. 20 PRIOR ART
FIG. 20 is a perspective view showing a conventional ink jet head.
Figure 21:
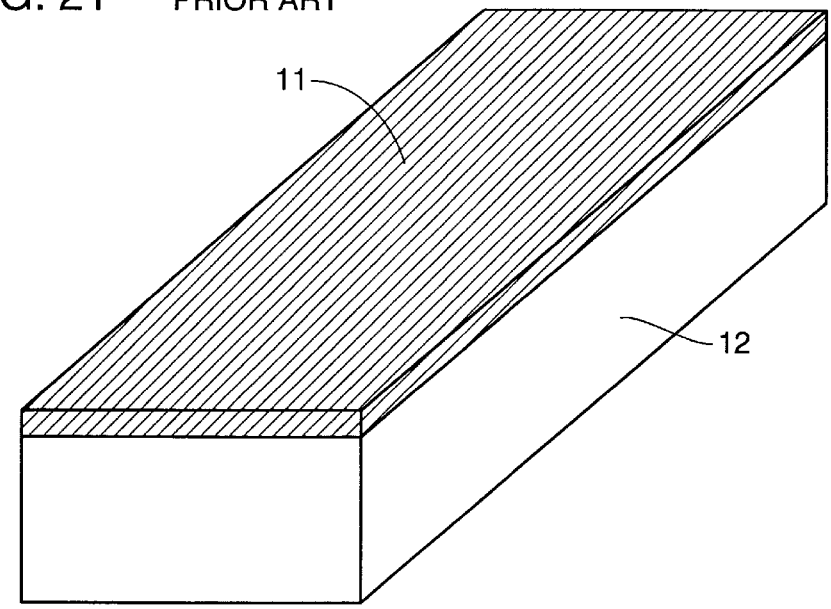
FIG. 21 PRIOR ART
FIGS. 21 and 22 are perspective views shown in conjunction with first and second steps of a conventional method of manufacturing an ink jet head.
Figure 22:
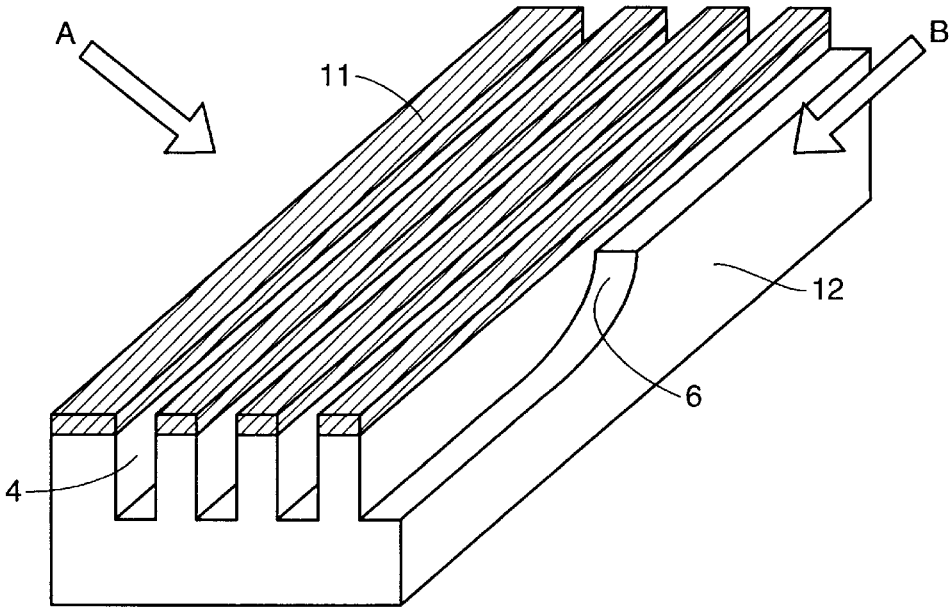
FIG. 22 PRIOR ART
Figure 23:
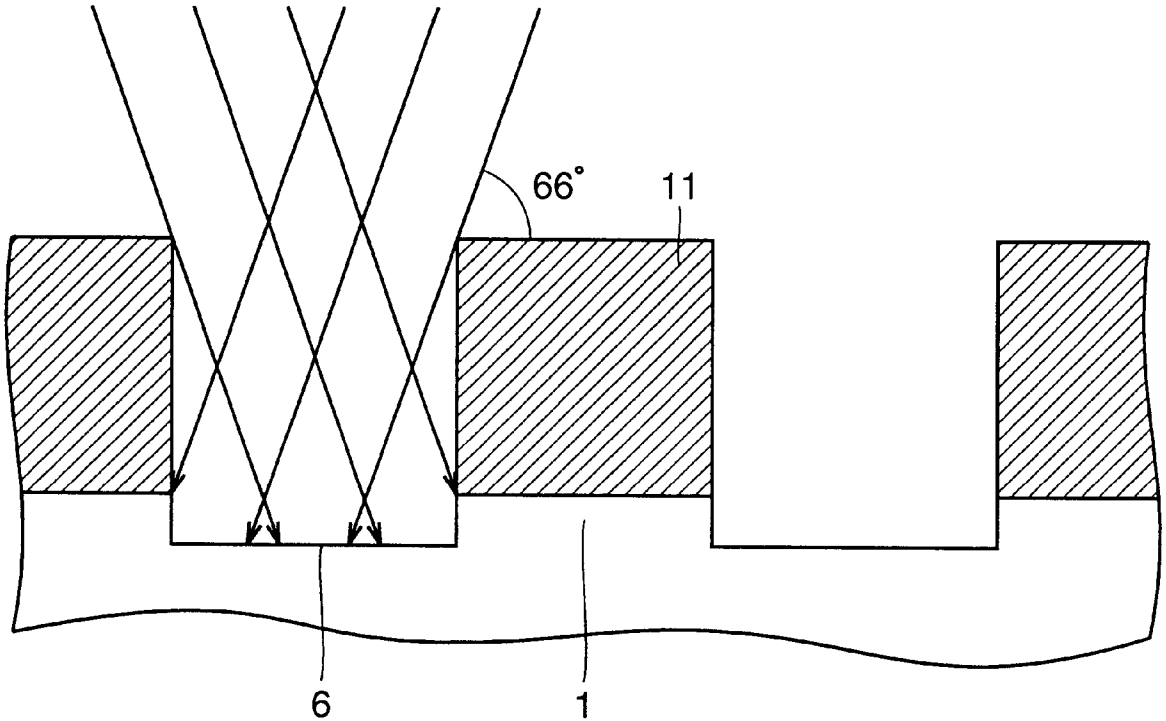
FIG. 23 PRIOR ART
FIG. 23 is a cross sectional view showing an electrode connecting portion of the conventional ink jet head.
Figure 24:
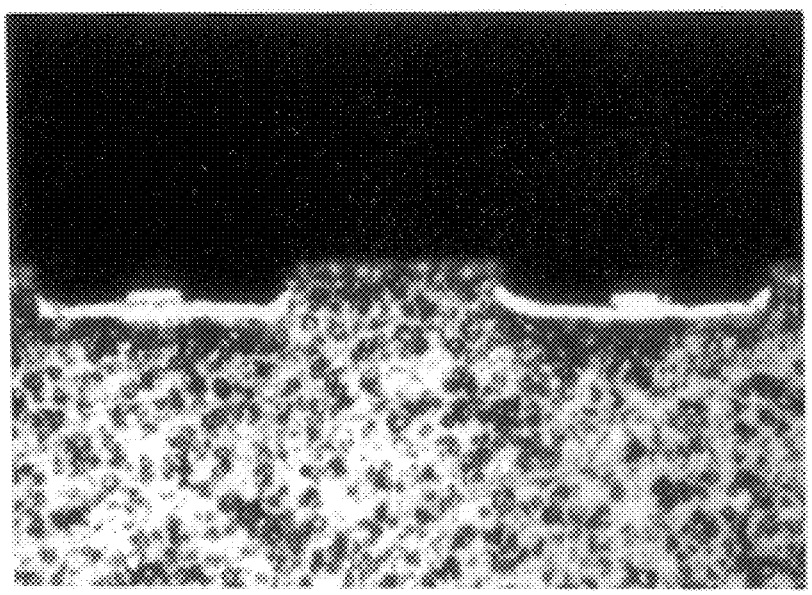
FIG. 24 PRIOR ART
FIG. 24 is a photograph showing a cross section of the electrode connecting portion of the conventional ink jet head.
Figure 25A:
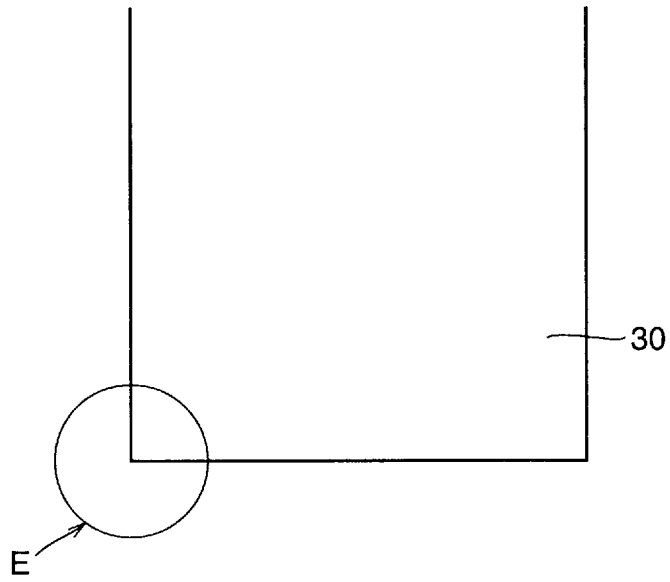
FIG. 25A PRIOR ART
FIGS. 25A and 25B are cross sectional views showing the dicing blades used for dicing.
Figure 25B:
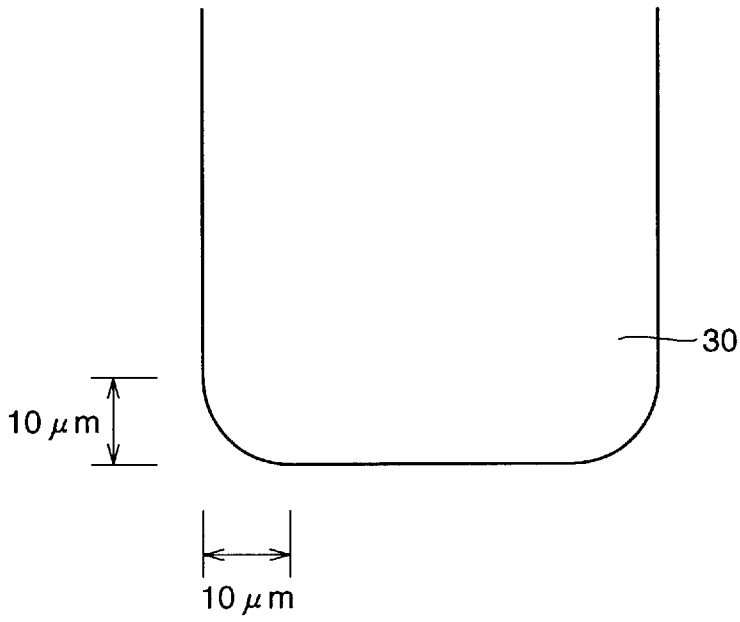
FIG. 25B PRIOR ART

Referring to FIG. 18, electrodes 5 formed on channel walls 3 are not isolated, but are electrically connected through the metal film formed in region E. Then, as shown in FIG. 19, grooves 24 are formed by a dicing process in region E formed on its entire surface the metal film and part of regions B2 and B3 formed with shallow groove portion 3, so that electrode connecting portion 23 is formed each connected to respective ink channel. Groove 24 used for forming the electrode connecting portion is formed with use of a dicing blade of a width 45 $\mu$m to have a width of 50 $\mu$m and depth of 30 $\mu$m. End C0 of the groove is formed not to be positioned in regions A and B1. Groove 24 is formed such that end C0 is positioned in region D. Thus, electrodes 5 of the metal films formed in respective ink channels are reliably isolated and connected to electrode connecting portion 23 without causing short circuit.

As described above, in the method of manufacturing the ink jet head of the present invention, the metal film to be the electrode is preliminary formed over the entire region to be the electrode connecting portion and then grooves for isolating the electrodes are formed. Thus, the electrode of the electrode connecting portion can be formed at a convex portion and, in connecting to the external electrode, a connection can be reliably made without causing connection failure by means of wire bonding or with use of an ACF. Further, since base member 1 maintains planarity of piezoelectric material 12 at the upper portion of the channel wall, a bonding of cover member 2 can be reliably made and ink leakage between adjacent ink channels is prevented.

In the manufacturing method of the present embodiment, the grooves for isolation of the electrodes are positioned in the region having a smaller depth and not positioned in the region of the channel wall or in the region having a greater depth. Thus, the strength of channel wall is not reduced.

As described above, in the ink jet head of the present invention, the electrode surface of the electrode connecting portion for making a connection to the external electrode is provided at the convex portion, so that a connection can be reliably made without causing connection failure in connecting the external electrode by means of wire bonding or with use of the ACF. X Further, in the manufacturing method of the ink jet head of the. present invention, the electrode connecting portion is formed at the convex portion. In addition, the planarity of the upper surface of the channel wall is maintained. Thus, the ink jet head capable of preventing ink leakage between adjacent ink channels and reliably connecting the external electrode can be manufactured.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet head, comprising:

a base member at least partially formed of a piezoelectric material, including a plurality of first grooves separated by walls and arranged in parallel in a surface of said piezoelectric material, and including electrodes on parts of the walls of said respective first grooves;

a cover member provided on said base member to cover the plurality of first grooves thereby forming ink channels to be a pressure chamber;

a nozzle communicating with an ink channel; and a plurality of electrode connecting portions formed on a surface of said base member for connecting said electrodes to an external portion, wherein said ink jet head applies a driving voltage to said electrodes to cause shear deformation of said walls so as to cause pressure vibration to said ink channels to allow said nozzle to eject ink, said plurality of electrode connecting portions are electrically isolated by second grooves formed in the surface of said base member, and surfaces of said electrode connecting portions are substantially flush with upper surfaces of said walls.

2. The ink jet head according to claim 1, wherein an end portion of said first grooves free from said nozzle has a slope portion, on which said electrode connecting portions extend, and said electrodes and said electrode connecting portions are electrically connected through the extending portion.

3. The ink jet head according to claim 2, wherein said slope portion partially has a planar surface in a direction toward said nozzle, and a distance between said planar surface to the surface of said base member is at most 100 $\mu$m.

4. The ink jet head according to claim 2, wherein said electrode connecting portions extend in a direction away from said nozzle from said slope portion.

5. The ink jet head according to claim 2, wherein said electrode connecting portions at said slope portions has a length of at least 50 $\mu$m.

6. The ink jet head according to claim 2, wherein said electrode connecting portion has a width of at least 40 $\mu$m and at most 100 $\mu$m.

7. The ink jet head according to claim 1, wherein said second grooves are formed on parts of upper surfaces of said walls between said ink channels adjacent to each other.

8. A method of manufacturing an ink jet head including a base member at least partially formed of a piezoelectric material, including a plurality of first grooves separated by walls and arranged in parallel in a surface of said piezoelectric material, and including electrodes on parts of the walls of said first grooves, a cover member formed to cover said plurality of grooves of said base member to provide ink channels to be a pressure chamber, and a nozzle communicating with said ink channel, said ink jet head applying a drive voltage to said electrodes to cause shear deformation of said walls so as to cause pressure vibration to said ink channels to allow said nozzle to eject ink, comprising the steps of:

preparing a substrate at least partially formed of a piezoelectric material;

forming grooves in a surface of said substrate with use of a resist having a prescribed pattern, so as to form an ink channels of said first grooves having a sloped end portion on a side opposite said nozzle;

forming a metal film on said slope and the surface of said substrate excluding a bottom portion of said ink channels; and dividing said metal film into a plurality of portions to form a plurality of electrically isolated electrode connecting portions.

9. The method of manufacturing the ink jet head according to claim 8, wherein a boundary of regions covered and not covered with said resist is a region of said slope.

10. The method of manufacturing the ink jet head according to claim 8, wherein said division of said electrode connecting portions is performed by physically removing parts of said metal film and said base member to provide second grooves.

11. The method of manufacturing the ink jet head according to claim 7, wherein said second grooves for dividing said electrode connecting portions extend to an upper surface of said walls.

* * * * *

UNITED STATES PATENT AND TRADEMARK OFFICE

CERTIFICATE OF CORRECTION

PATENT NO. : 6,513,916 B2 
DATED : February 4, 2003
INVENTOR(S) : Hitoshi Isono and Yoshinori Nakajima It is certified that error appears in the above-identified patent and that said Letters Patent is hereby corrected as shown below:

Column 14,
Line 20, change "portion" to -- portions --; and
Line 42, delete "an".

Signed and Sealed this

Fifth Day of August, 2003

JAMES E. ROGAN
*Director of the United States Patent and Trademark Office*